United States Patent [19]

Kovacs et al.

[11] 4,008,009

[45] Feb. 15, 1977

[54] FUEL INJECTION PUMP

[76] Inventors: Endre Kovacs; Peter Kovacs; Michael Kovacs, all of 1708 Cedar Drive; Marta Kovacs, 1707 Cedar Drive; Geza Kovacs, 1610 Cedar Drive, all of Plant City, Fla. 33566

[22] Filed: Sept. 30, 1975

[21] Appl. No.: 618,178

[52] U.S. Cl. ..... 417/387; 123/139 AE; 417/500

[51] Int. Cl.[2] ..... F04B 9/10; F04B 7/06; F02M 59/26

[58] Field of Search ..... 417/386, 387, 500, 492, 417/499, 289; 123/139 AR, 139 AE, 139 BD

[56] References Cited

UNITED STATES PATENTS 2,670,684 3/1954 Fagerholt ..... 417/386

2,843,045 7/1958 Mashinter ..... 417/386 X

FOREIGN PATENTS OR APPLICATIONS 298,176 10/1928 United Kingdom ..... 417/386

*Primary Examiner*—C. J. Husar
*Assistant Examiner*—Leonard Smith
*Attorney, Agent, or Firm*—A. Yates Dowell, Jr.

[57] ABSTRACT

Pump apparatus for injecting combustible fuel under high pressure into a diesel type internal combustion engine. The apparatus includes a body having a cavity with a diaphragm therein and an adjustable variable pressure applied intermittently to one side of the diaphragm causes a selected quantity of fuel to be pumped through the cavity on the other side of the diaphragm.

2 Claims, 5 Drawing Figures

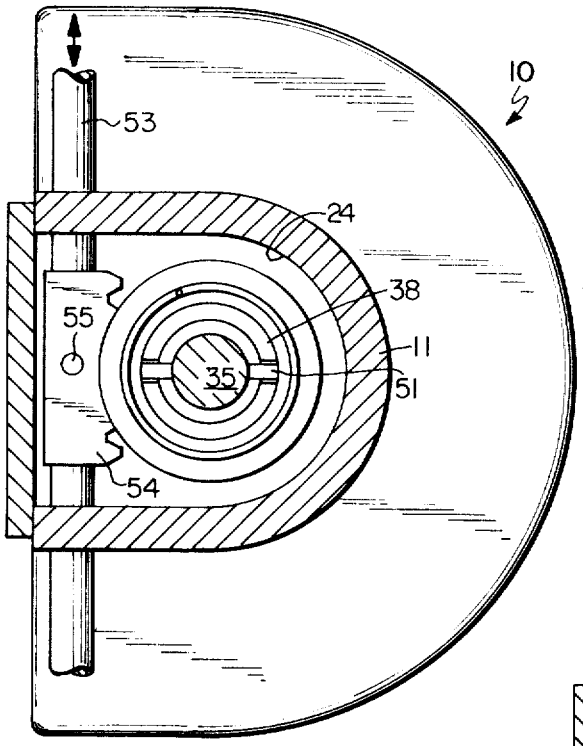
FIG. 3
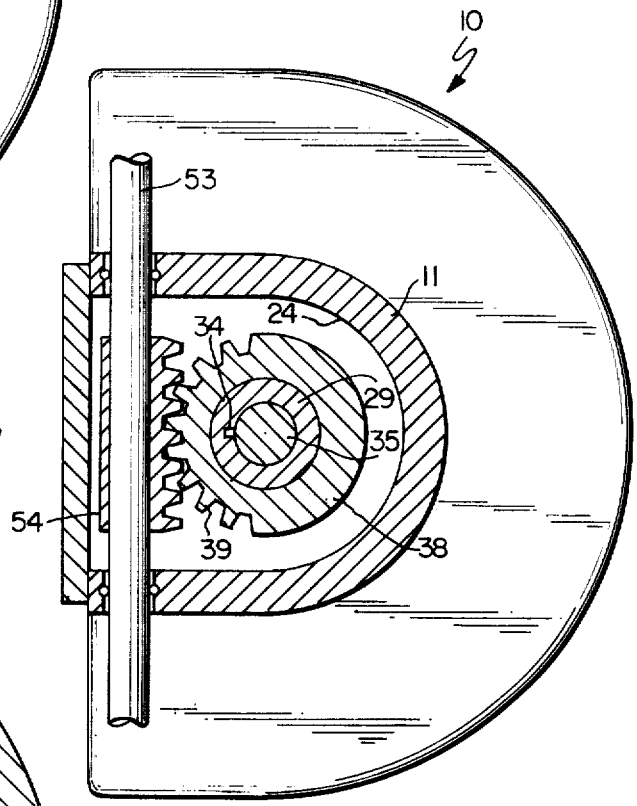
FIG. 4
FIG. 5
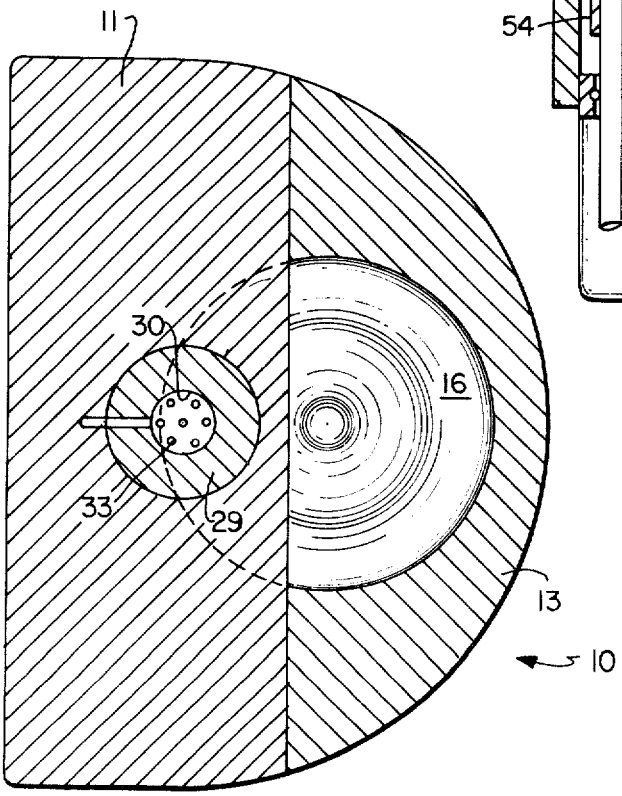

FUEL INJECTION PUMP

BACKGROUND OF THE INVENTION

1. Field of the Invention

This invention relates generally to fuel pumps for internal combustion engines and relates particularly to fuel injection pumps for injecting gasoline under high pressure into a diesel type internal combustion engine.

2. Description of the Prior Art

Heretofore fuel pumps of various kinds have been provided for pumping fuel from a fuel supply tank to an internal combustion engine and many of these pumps have included diaphragms which were connected to a finger or lever and engaged a rotating cam to create a differential in pressure on at least one side of the diaphragm. Normally fuel is introduced into gasoline type internal combustion engines at relatively low pressures or during the suction stroke of the pistons and therefore such fuel pumps could use diaphragms constructed of rubber, neoprene or other resilient material.

Some efforts have been made to provide injection pumps which utilized a non-compressible fluid such as oil or the like on one side of the diaphragm so that the power stroke of a cam operated piston applied pressure to the oil and caused the diaphragm to move. The return stroke of the pump caused a suction or subatmospheric pressure to be applied to the diaphragm and caused the diaphragm to move to the other side of the diaphragm cavity so that fuel flowed into the cavity from which such fuel was pumped on the next power stroke of the piston. Some examples of the prior art are the U.S. Pat. Nos. to Gambrell 2,138,849; Dodson 2,343,962; Mashinter 2,948,223; Dean et al. 2,960,936; and Cary 3,620,649.

SUMMARY OF THE INVENTION

The present invention is embodied in a fuel injection pump including a body having a diaphragm cavity with a metallic diaphragm mounted therein. One side of the cavity is provided with a fuel inlet port and a fuel outlet port each of which has one-way valve structure so that fuel is introduced into the cavity when the diaphragm is moved in one direction and is discharged from the cavity when the diaphragm is moved in the opposite direction. The other side of the cavity communicates with a reservoir of non-compressible liquid such as light oil or the like. An adjustable cam operated piston is provided for selectively controlling the application of pressure through the non-compressible liquid to the diaphragm on the power stroke of the piston to apply a selected pressure to one side of the diaphragm and for applying a suction or subatmospheric pressure on the diaphragm on the return stroke of the piston. A sleeve which receives the piston has a generally vertically disposed groove and the piston is provided with an inclined slot which communicates with the groove not only to selectively vary the pressure applied on the power stroke of the piston, but also to dissipate air bubbles created by differential pressure within the non-compressible liquid.

BRIEF DESCRIPTION OF THE DRAWINGS

FIG. 3 is a section on the line 3—3 of FIG. 1.

FIG. 4 is a section on the line 4—4 of FIG. 1.

FIG. 5 is a section on the line 5—5 of FIG. 1.

DESCRIPTION OF THE PREFERRED EMBODIMENT

Figure 2:
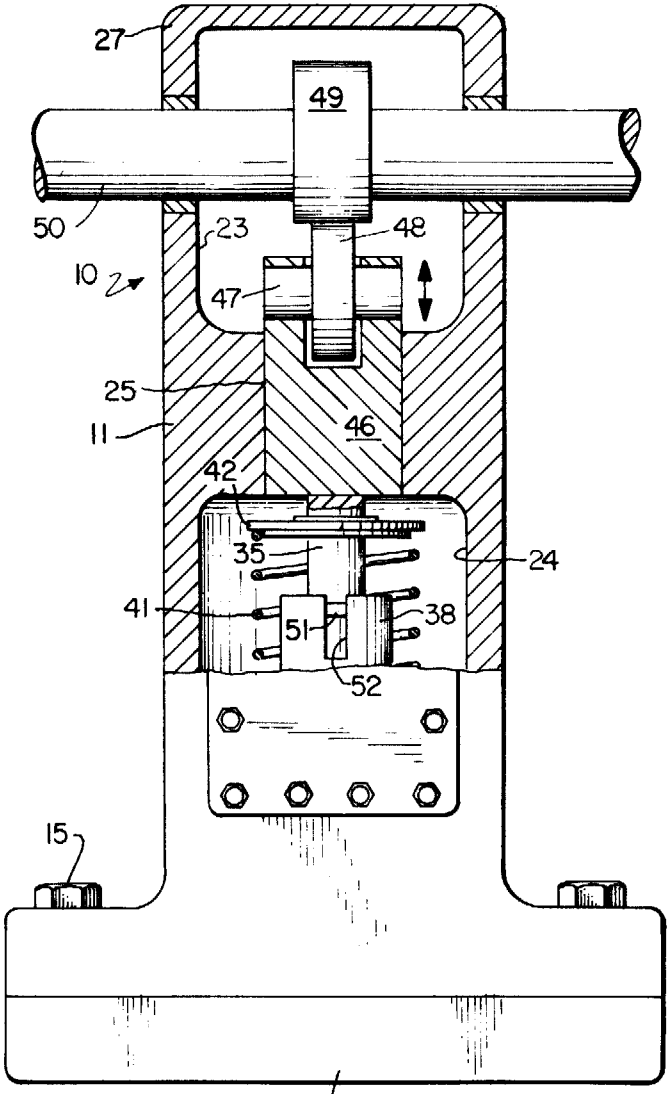
FIG. 2 is a side elevation partly in section taken on the line 2—2 of FIG. 1.

With continued reference to the drawings, a fuel injection pump 10 for injecting gasoline or other combustible fuel into a diesel engine is provided and includes a body 11 having a relatively wide shallow recess 12 at its lower end. A cap 13 having a relatively wide shallow recess 14 in its upper surface is clamped or otherwise mounted on the body 11 in any desired manner, as by bolts 15 or the like. The body recess 12 and the cap recess 14 are in opposed cooperating relationship and define a cavity which is separated into upper and lower portions by a diaphragm 16.

Preferably the diaphragm 16 is constructed of metal such as stainless steel and is provided with a plurality of concentric wavy generally circular undulations which permit the central portion of the diaphragm to move within the diaphragm cavity while the peripheral portions of the diaphragm are secured in fixed position between the body 11 and the cap 13. Such cap has an inlet port 17 which is connected by means of a one-way ball type check valve 18 to a fuel line (not shown) which leads to a fuel supply tank. Also such cap has an outlet port 19 which communicates with the recess 14 and such outlet port is connected by a one-way ball type check valve 20 to a discharge line (not shown) which leads to a piston chamber of a diesel type internal combustion engine.

The body 11 is provided with an upper reservoir 23 and a lower reservoir 24 connected by a bore 25 and such upper and lower reservoirs normally are filled with a non-compressible liquid such as light oil 26. The upper reservoir 23 is closed by a cover 27 and the lower reservoir 24 is closed by an inspection plate 28. An axially disposed barrel 29 having a cylindrical bore 30 is mounted in the lower portion of the body 11. The lower portion of the barrel includes a radially disposed opening or passageway 31 which is aligned with an inclined passageway 32 through a portion of the body 11 to provide communication between the lower reservoir 24 and the lower portion of the bore 30 so that oil from the reservoir 24 may flow by gravity into the bore 30. The body 11 has a plurality of orifices 33 providing communication between the upper portion 12 of the diaphragm cavity and the bore 30 of the barrel so that the oil 26 flows into the upper portion of such diaphragm cavity. An elongated groove 34 extends along the bore 30 from the passageway 31 to the upper end of the barrel 29 for a purpose which will be described later.

A piston 35 is slidably mounted within the bore 30 of the barrel 29 and the lower end of such piston is provided with an upwardly inclined peripheral groove 36 which selectively communicates with the groove 34 of the barrel. A thrust bearing or retainer 37 is mounted on a shoulder of the barrel 29 and such thrust bearing supports a control sleeve 38 having a segmental gear 39 formed at its lower end. A spring seat 40 is carried by the control sleeve 38 and receives one end of a compression spring 41. The opposite end of the spring 41 engages a collar or spring seat 42 which is connected to the piston 35 in any desired manner as by a snap ring or washer 43. With this construction the spring 41 urges the piston 35 toward retracted position.

In order to move the piston 35 downwardly against the tension of the spring 41, a tappet 46 is slidably mounted in the bore 25 and the lower surface of such tappet abuts the upper end of the piston 35. As illustrated best in FIGS. 1 and 2, the upper end of the tappet is provided with a shaft 47 on which a roller 48 is freely rotatably mounted. A cam member 49, which is mounted on a cam shaft 50, engages the roller 48 so that rotation of the cam shaft causes the cam member 49 to move the tappet 46 and the piston 35 downwardly during a portion of the rotation of the cam member against the tension of the spring until the crest of the cam member passes the roller 48. Continued rotation of the cam shaft 50 permits the spring 41 to return the piston 35 to the retracted position. Downward movement of the piston 35 moves the lower end of the piston past the passageway 31 so that no oil can flow from the lower reservoir 24 into the bore 30; however, as long as the groove 36 in the lower end of the piston is in communication with the groove 34 of the barrel, the oil trapped in the bore 30 moves up the grooves 36 and 34 and is returned to the lower reservoir 24. When the piston has moved downwardly a distance such that the groove 36 no longer communicates with the groove 34, the oil from the bore 30 can no longer be discharged upwardly and therefore the piston forces the oil through the orifices 33 into the upper portion of the diaphragm cavity to move the central portion of the diaphragm downwardly.

The downward movement of the diaphragm increases the pressure on the gasoline or other fluid in the lower portion of the diaphragm cavity which closes the check valve 18 on the inlet port and opens the check valve 20 of the outlet port so that fuel within the lower portion of the diaphragm cavity is forced under high pressure into the cylinder chamber of an internal combustion engine. At the completion of the power stroke of the piston, the spring 41 urges the piston 35 and tappet 46 upwardly to relieve the pressure in the upper portion of the diaphragm cavity and create a suction or subatmospheric pressure therein which raises the central portion of the diaphragm 16 to the upper portion of the diaphragm cavity. When this condition occurs, the check valve 20 of the outlet port closes and the check valve 18 of the inlet port opens so that another charge of fuel is introduced into the lower portion of the diaphragm cavity.

In order to control the quantity of fuel being pumped, the piston 35 is adapted to be rotated relative to the barrel 29 to control the point of communication between the groove 36 of the piston and the groove 34 of the barrel. This is done by providing a pair of outwardly extending ears 51 on the piston 35 and such ears are retained within grooves 52 in the upper portion of the control sleeve 38. The control sleeve grooves are deep enough so that the ears 51 do not engage the bottom of the grooves during the entire stroke of the piston. A control rod 53 extends through the body 11 and through the lower reservoir 24 therein. A toothed rack 54 is adjustably mounted on the control rod in any desired manner, as by a set screw 55. The teeth of the rack 54 mesh with the segmental gear 39 of the control sleeve so that back-and-forth movement of the control rod 53 causes partial rotation of the sleeve 38. Since the ears 51 of the piston are retained within the grooves 52 of the control sleeve, rotation of the control sleeve causes the piston 35 to rotate relative to the barrel 29 and vary the point where the groove 36 crosses and communicates with the groove 34.

Figure 1:
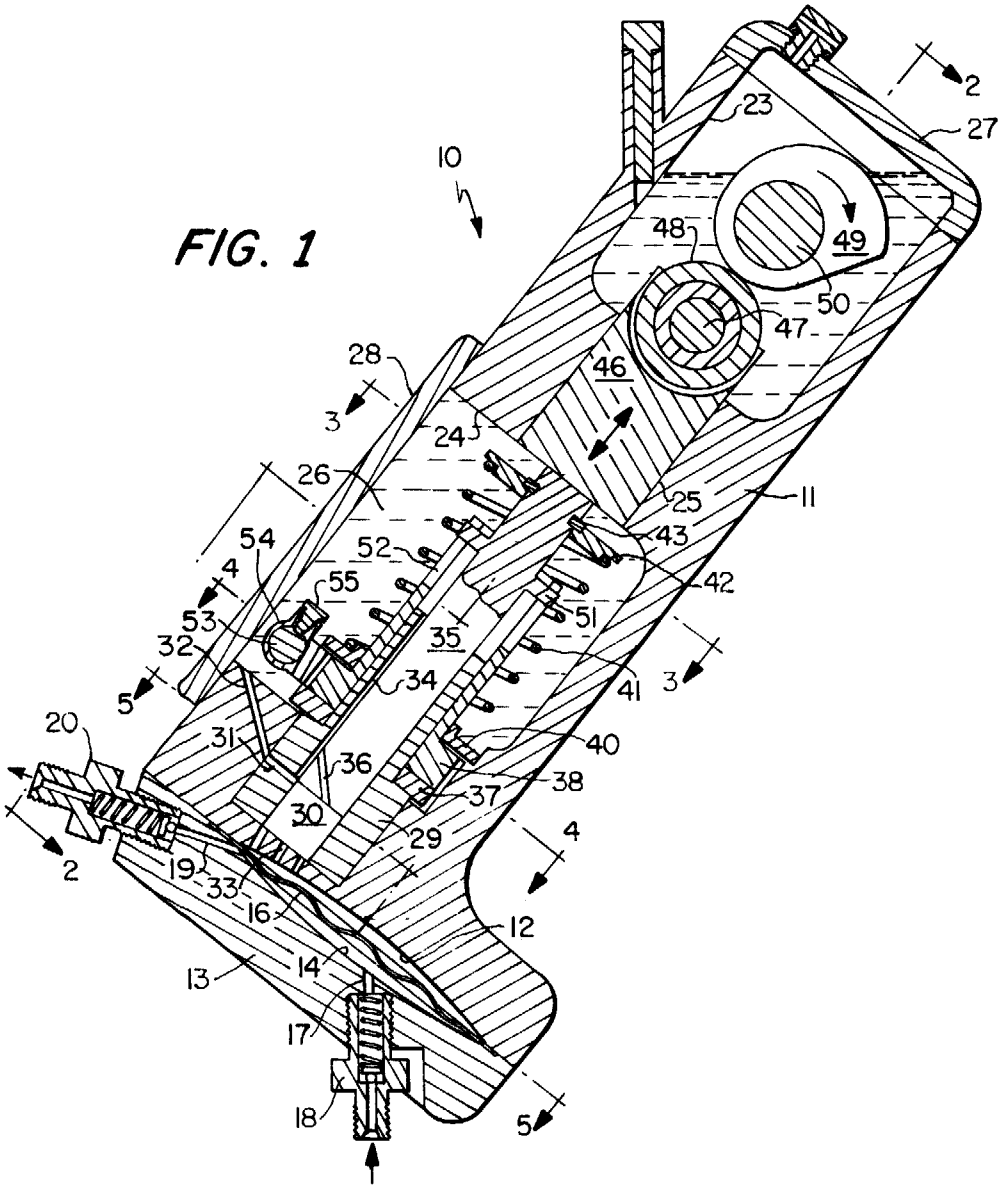
FIG. 1 is a vertical section through the injection pump of the present invention.

With particular reference to FIG. 1, it is noted that the fuel injection pump 10 is an independent unit which can be readily manufactured and placed on a diesel type internal combustion engine in an inclined position. When the pump is inclined, the barrel 29 is located in a position such that the groove 34 is uppermost. Occasionally air bubbles are created in the oil 26 due to the large pressure changes and any air bubbles trapped in the bore 30 tend to move toward the top of the oil where they are discharged through the grooves 36 and 34 into the lower reservoir 24.

In the operation of the device, the control rod 53 is operated to rotate the segmental gear 39 and the control sleeve 38 to a desired position. The control sleeve rotates the piston 35 to regulate the point of intersection between the grooves 34 and 36 which in turn controls the amount of oil discharged from the bore 30 during the power stroke of the piston 35. In other words, when the piston is rotated to a position where the point of intersection between the grooves 34 and 36 is adjacent to the lower end of the piston, only a small quantity of oil is discharged from the bore 30 before downward or axial movement of the piston carries the groove 36 out of communication with the groove 34 so that substantially all of the oil within the bore is forced into the upper portion of the diaphragm cavity and substantially all of the fuel in the lower portion of such cavity is pumped through the outlet port 19. On the other hand, when the piston 35 is rotated so that the upper end of the groove 36 communicates with the groove 34 of the barrel, most of the oil within the bore 30 passes through the grooves so that little pressure is applied to the upper portion of the diaphragm 16.

Since the diaphragm 16 is constructed of stainless steel or the like, it is desirable to provide large pressures which are created by small amounts of movement of the diaphragm. This is done by providing a relatively large shallow diaphragm cavity in which the area of the movable portion of the diaphragm is approximately 30 times as large as the area of the piston 35.

It is noted that the fuel injection pump of the present invention could be manufactured as part of an internal combustion engine, or could be manufactured as a replacement unit for a fuel pump on an existing internal combustion engine. Also it is apparent that although a single fuel pump has been illustrated in the drawings and described in the specification, such fuel pump usually serves a single cylinder and therefore when the internal combustion engine has a plurality of pistons and cylinders, a corresponding number of fuel pumps normally are required. When the internal combustion engine has a plurality of pistons and cylinders, a common cam shaft 50 may be provided having a plurality of cam members 40 which are set for any desired sequence and firing order or, if desired, a plurality of cam shafts may be provided which are rotated in timed relationship to each other.

We claim:

1. A fuel injection pump for pumping fuel under high pressure to an internal combustion engine comprising a body having cap means at one end, said body and said cap means having cooperating recesses defining a diaphragm cavity, a diaphragm located between said body and said cap means and separating said cavity into upper and lower portions, said cap means having inlet and outlet valve means communicating with the lower portion of said diaphragm cavity, said body having a reservoir for receiving a non-compressible liquid, a barrel having an axial bore mounted in said body and extending into said reservoir, passageway means providing communication between said reservoir and the lower portion of the bore of said barrel, said barrel having a groove extending along said bore between said passageway means adjacent said lower portion of the bore of said barrel and said reservoir adjacent the upper end of said barrel, a piston slidably mounted within said bore, means for moving said piston along the bore of said barrel, said piston having an angularly disposed peripheral groove extending upwardly from the lower end thereof, means for rotating said piston to alter the point of communication between the groove of said piston and the groove of said barrel so that said groove of said piston may selectively communicate with the groove of said barrel to permit said non-compressible liquid and gas bubbles to continuously pass through said angularly disposed peripheral groove of said piston and said groove of said barrel as said piston is moved along the bore of said barrel until said peripheral groove is moved from open communication with said groove of said barrel, and said body having at least one opening providing communication between the bore of said barrel and the upper portion of said diaphragm cavity, whereby the quantity of liquid forced from the bore of the barrel into the upper portion of the diaphragm cavity is regulated by the relative positions of the grooves in said piston and the bore of said barrel.

2. The structure of claim 1 in which said means for moving said piston includes a tappet slidably mounted in said body and having one end thereof abutting an end of said piston, a cam member engaging the other end of said tappet, said cam member being fixed to a rotatable cam shaft, and means for maintaining said piston in abutting relationship with said one end of said tappet so that said tappet is in substantially constant engagement with both said piston and said cam member.

* * * * *